US006963712B2

(12) United States Patent
Wachter

(10) Patent No.: US 6,963,712 B2
(45) Date of Patent: Nov. 8, 2005

(54) HOPPER KEY FOR IMAGE FORMING APPARATUS AND TONER REFILLING KIT INCLUDING THE SAME

(76) Inventor: Heidi Wachter, 26 B Block 8, Laguna Verde, Hung Hom, Kowloon (HK)

( * ) Notice: Subject to any disclaimer, the term of this patent is extended or adjusted under 35 U.S.C. 154(b) by 0 days.

(21) Appl. No.: 10/787,135

(22) Filed: Feb. 27, 2004
(Under 37 CFR 1.47)

(65) Prior Publication Data

US 2005/0191093 A1 Sep. 1, 2005

(51) Int. Cl.[7] ..... G03G 15/08
(52) U.S. Cl. ..... 399/258; 399/27; 399/107; 399/119
(58) Field of Search ..... 399/107, 119, 120, 399/258, 262, 110, 111, 125, 27; 222/DIG. 1

(56) References Cited

U.S. PATENT DOCUMENTS 5,105,218 A 4/1992 Ikeda et al. ..... 399/27
5,115,275 A 5/1992 Suzuki ..... 399/24
5,175,587 A 12/1992 Kato et al. ..... 399/262

FOREIGN PATENT DOCUMENTS

JP 03-129370 A * 6/1991
JP 04-110972 A * 4/1992
JP 04-110973 A * 4/1992

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A key for unlocking locking-type toner hoppers includes at least one projection configured to unlock a locking-type toner hopper. The key is not monolithically formed with a toner container. A kit includes the key and a toner container where the key is not monolithically formed with the toner container. Preferably, the key includes a plurality of projections arranged into two sets of projections, each set being configured to unlock one type of a locking toner hopper.

20 Claims, 8 Drawing Sheets

FIG. 13
(BACKGROUND ART)
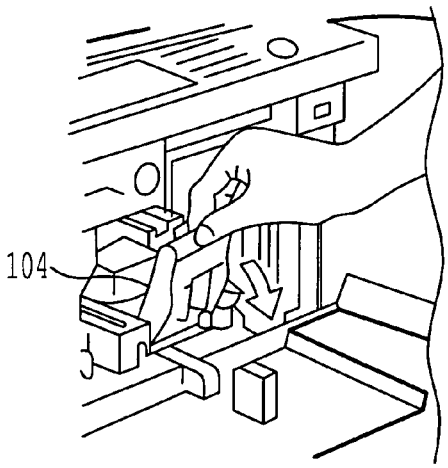
FIG. 14
(BACKGROUND ART)
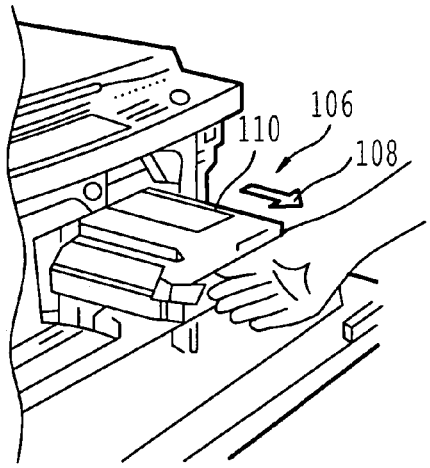
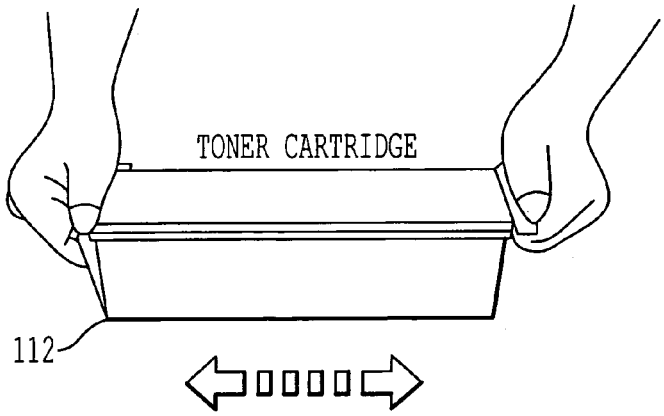
FIG. 15
(BACKGROUND ART)
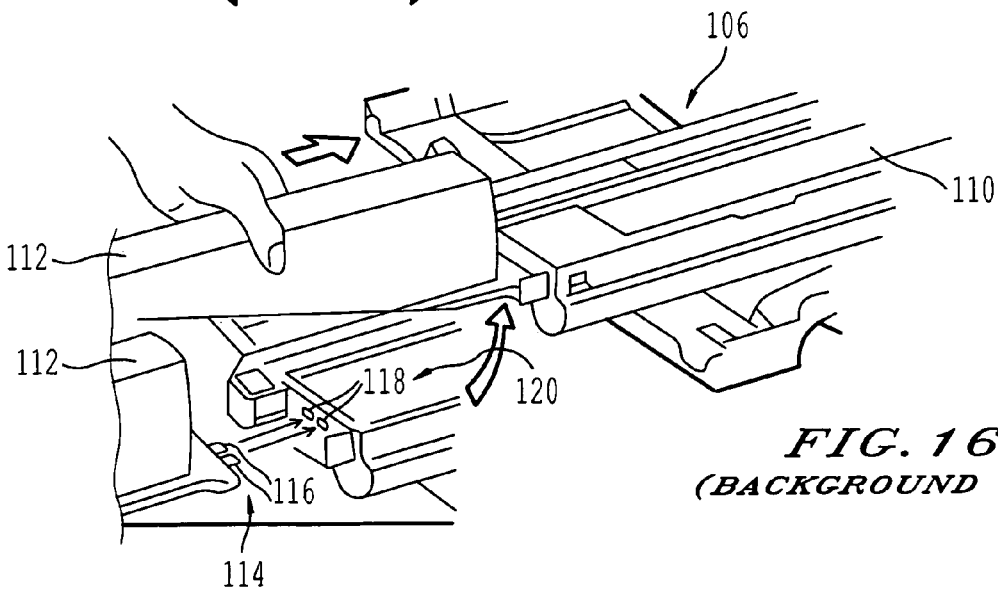
FIG. 16
(BACKGROUND ART)

HOPPER KEY FOR IMAGE FORMING APPARATUS AND TONER REFILLING KIT INCLUDING THE SAME

BACKGROUND OF THE INVENTION

1. Field of the Invention

The invention relates to a key for opening a hopper of an image forming apparatus, and particularly to a key for unlocking a locking-type hopper of an image forming apparatus, and a toner refilling kit including such a key.

2. Discussion of the Background

Image forming apparatuses, such as printers, photocopiers and facsimiles, typically apply a thermosetting image forming substance such as dry ink or what is commonly referred to as "toner," in order to form images on paper, for example. As image forming processes are performed, the toner is eventually depleted and therefore, must be refilled. Known image forming apparatuses are constructed with an array devices related to refilling the toner reservoir included in the image forming apparatus. For example, a toner reservoir in an image forming apparatus may have a hingedly attached lid that is simply opened by hand, allowing toner to be poured into the reservoir, from a bottle, for example. Alternatively, the reservoir may include a specialized coupling for engaging corresponding devices provided on replacement containers that are inserted into the image forming apparatus and which remain in the image forming apparatus during use, and which must be entirely replaced when toner is to be added to the image forming apparatus. Similarly, some toner reservoirs of image forming apparatuses, in order to be refilled, must be unlocked, and engaged with a specialized container which is opened after engaging the container with the reservoir. After the hopper is refilled, the specialized container is disengaged and discarded or returned to the manufacturer for refilling.

For example, referring to FIGS. 12–19, a refilling operation using a typical refill container is shown therein. As shown in FIGS. 12 to 14, an access panel 102 of image forming apparatus 100 is rotated downward to expose toner hopper release lever 104 and toner hopper 106. As shown in FIGS. 13 and 14, after hopper release lever 104 is rotated downwardly, as viewed in FIG. 13, toner hopper 106 can be pulled outwardly, in direction of arrow 108, so as to expose hopper lid 110. In this image forming apparatus, toner hopper 106 is a locking-type toner hopper, in which the lid 110 is locked in a closed position as shown in FIG. 14. In order to open lid 110, toner refill cartridge manufacturers have been known to provide an unlocking device incorporated onto a toner cartridge, such as toner cartridge 112. As shown in FIG. 16, the toner cartridge 112 includes an unlocking device 114 which includes two pins 116 for insertion into apertures 118 of the locking device 120 incorporated into hopper 106. As shown in FIG. 17, once pins 116 are inserted into apertures 118, lid 110 can be rotated upwards to expose the interior of the hopper 106. As shown in FIGS. 18 and 19, once lid 110 is opened, toner cartridge 112 can be installed onto hopper 106 and subsequently opened so as to drop the toner stored in toner cartridge 112, into hopper 106. As shown in FIGS. 18 and 19, toner cartridge 112 includes specialized components, such as tabs 122 which fit into recesses 124 of hopper 106. After the toner containing toner cartridge 112 has been emptied into hopper 106, lid 110 can be closed, and hopper 106 can be returned to its operating position.

However, such specialized refill containers are expensive to manufacture due to the differing couplings required for engaging each specific toner hopper, which can add significant overhead costs to operating and maintaining image forming apparatuses. In addition, if a business has a number of different types of photocopiers, an inventory of different specialized toner refill containers must be maintained. Therefore, it is desirable to simplify and minimize the costs involved with refilling toner reservoirs of image forming apparatuses.

SUMMARY OF THE INVENTION

It is an object of the present invention to provide a device for reducing the complexity and costs associated with refilling toner reservoirs of image forming apparatuses. It is a further object of the invention to provide a kit which includes the necessary tools for simplifying the refilling of reservoirs which has heretofore required specialized products.

These and other objects of the invention can be provided by the present invention, which provides a key for unlocking a toner hopper of an image forming apparatus. At least one protrusion is attached to a first member, the protrusion configured to unlock a locking-type toner hopper of an image forming apparatus. The key is not formed monolithically with a toner container.

BRIEF DESCRIPTION OF THE DRAWINGS

A more complete appreciation of the present invention, and many of the attendant advantages thereof, will be readily ascertained and/or obtained as the same becomes better understood by reference to the following detailed description when considered in connection with the accompanying drawings, wherein:

FIGS. 13 and 14 are perspective views illustrating the removal of a hopper from a known image forming apparatus.

FIG. 15 illustrates a known toner cartridge.

FIG. 16 illustrates the use of a known toner cartridge for unlocking a toner hopper.

DETAILED DESCRIPTION OF THE PREFERRED EMBODIMENTS

Examples of preferred embodiments of the present invention will now be described with reference to the drawings, wherein like reference numbers throughout the several views identify like and/or similar elements.

Figure 1:
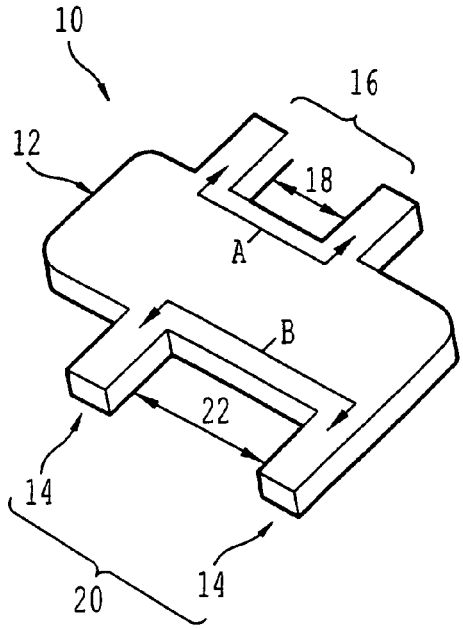
FIG. 1 is a perspective view of a key for unlocking a hopper of an image forming apparatus, according to the present invention.

FIG. 1 illustrates a key for unlocking a hopper according to the present invention. As shown in the figure, key 10 includes a body 12, at least one projection 14, and is formed separately from a toner refill container. Projection 14 is configured to unlock a lock for the lid of a toner hopper of an image forming apparatus (described in detail below).

In another preferred embodiment, key 10 includes at least two parallel projections 16 having a spacing 18. The at least two projections 16 are arranged so as to be received by a lock of a toner hopper of an image forming apparatus. Additionally, key 10 can include at least two parallel second projections 20 having spacing 22, wherein spacing 22 is longer than spacing 18. This allows key 10 to be used on at least two different locking-type toner hoppers of image forming apparatuses. As shown in FIG. 1, first member 12 can be of any shape, but is preferably substantially planar, which is simple to manufacture. Preferably, member 12 is of such a size so as to be easily grasped by a human hand.

Figure 5:
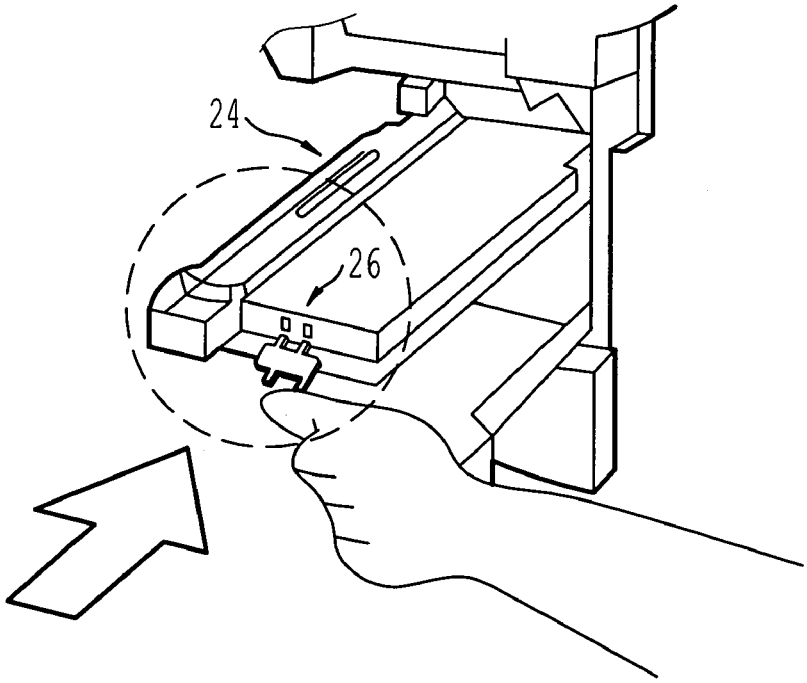
FIGS. 5 and 6 are perspective views of a hopper of an image forming apparatus and illustrate the operation of a key for unlocking the hopper according to the present invention.
Figure 6:
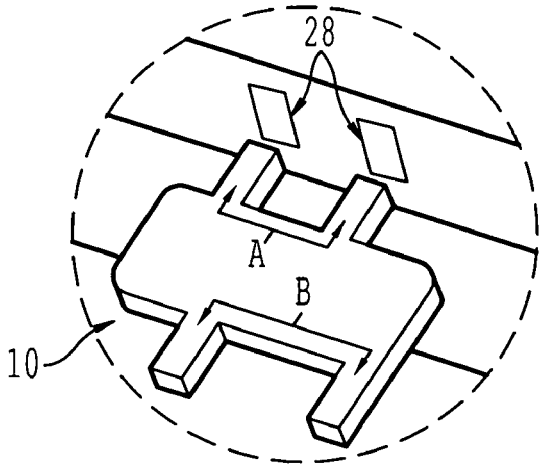

Referring now to FIG. 5, toner hopper 24 includes locking mechanism 26. As shown in FIG. 6, locking mechanism 26 includes a pair of apertures 28.

A refilling procedure for refilling toner hopper 24 will now be described below.

Figure 3:
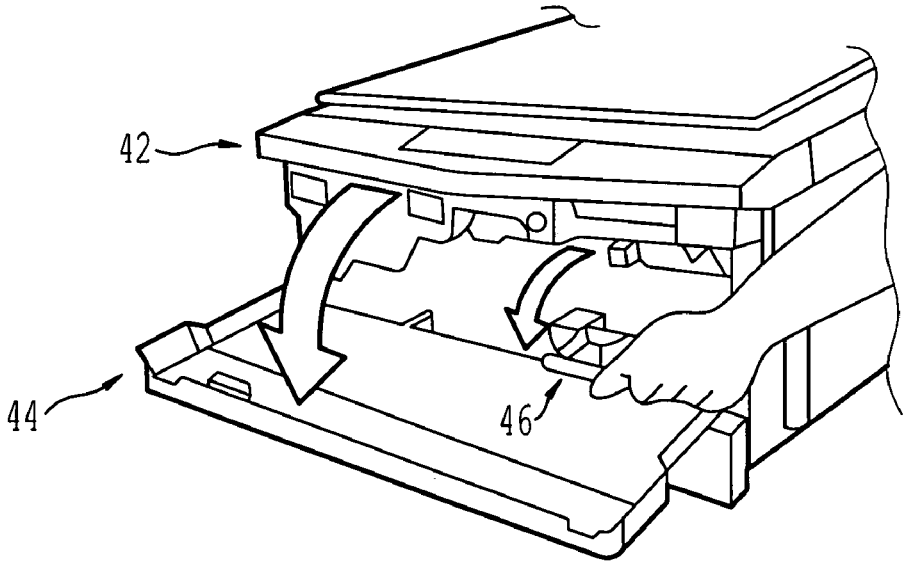
FIG. 3 is a perspective view illustrating the movement of an access panel of an image forming apparatus.

Referring now to FIG. 3, when it is desired to refill a toner hopper of an image forming apparatus, such as photocopier 42 as shown in FIG. 3, it is usually necessary to open an access panel such as access panel 44 as shown in FIG. 3. Thereafter, a toner hopper release lever 46 is rotated as shown in FIG. 3, and toner hopper 24 is pulled outward from image forming apparatus 42 so as to expose lid 40 of toner hopper 24, as shown in FIG. 4.

Figure 4:
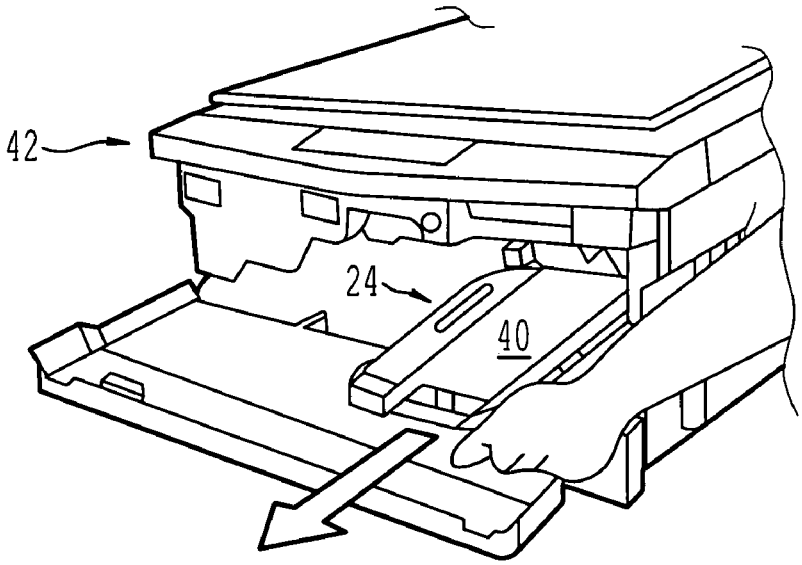
FIG. 4 is a perspective view of an image forming apparatus illustrating the movement of a hopper of the image forming apparatus.
Figure 7:
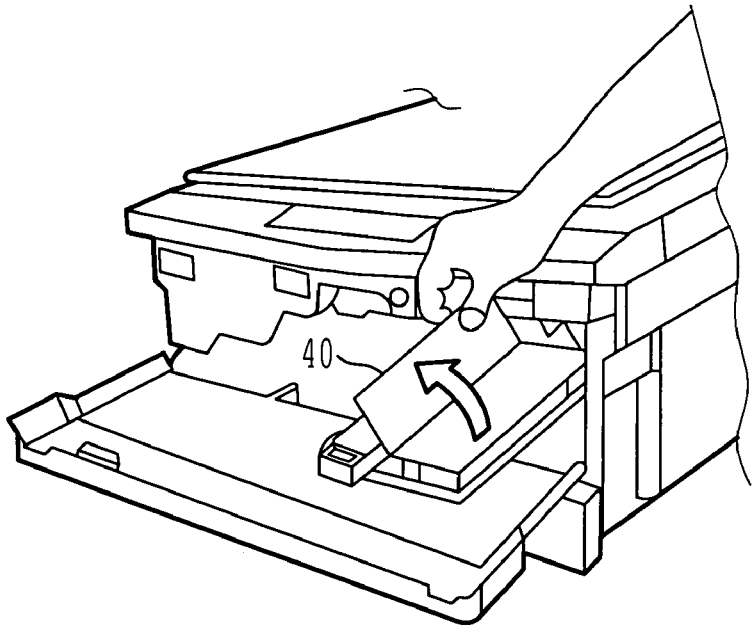
FIG. 7 is a perspective view of an image forming apparatus illustrating the movement of a lid of a hopper of an image forming apparatus.
Figure 8:
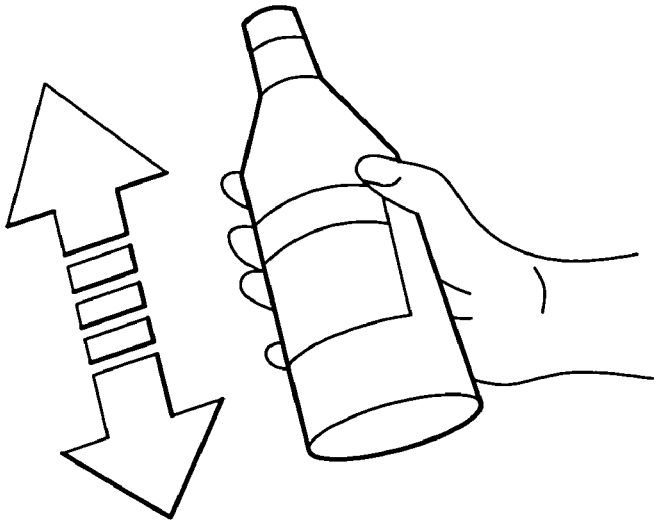
FIG. 8 is a perspective view of a toner container.
Figure 9:
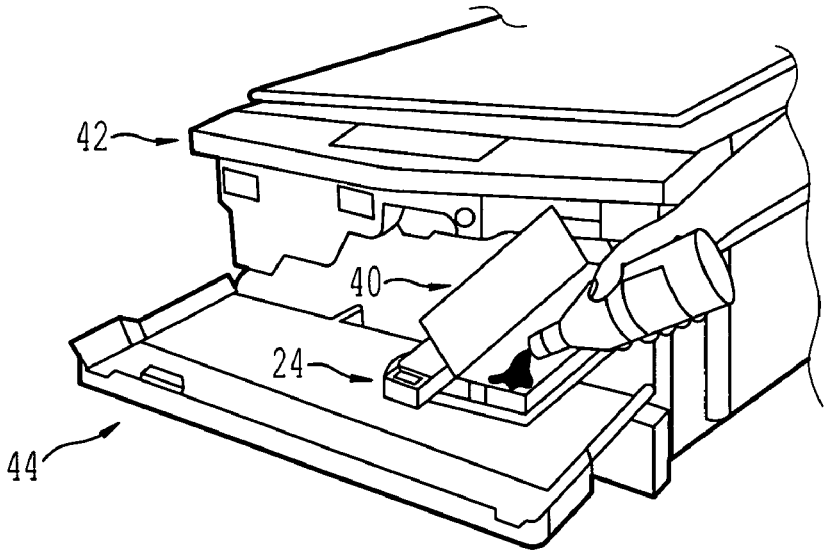
FIG. 9 is a perspective view of an image forming apparatus illustrating the use of a toner bottle to refill the hopper.
Figure 10:
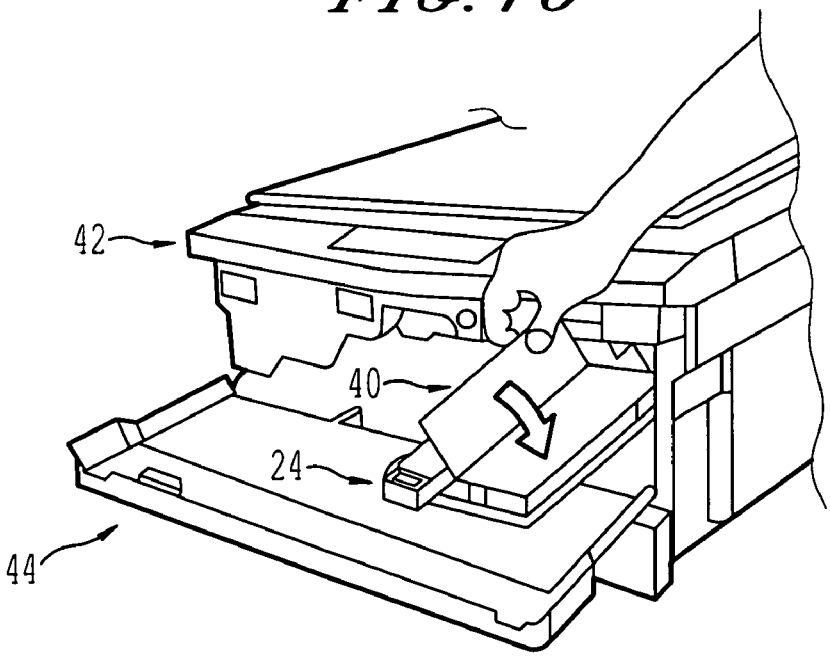
FIG. 10 is a perspective view of an image forming apparatus illustrating movement of closing the lid on the hopper.
Figure 11:
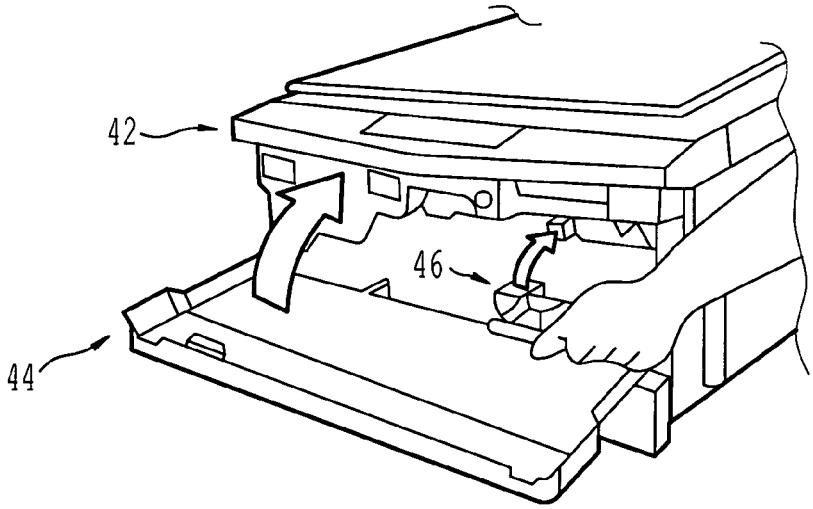
FIG. 11 is a perspective view of an image forming apparatus illustrating the movement of the access panel for closing the image forming apparatus.
Figure 12:
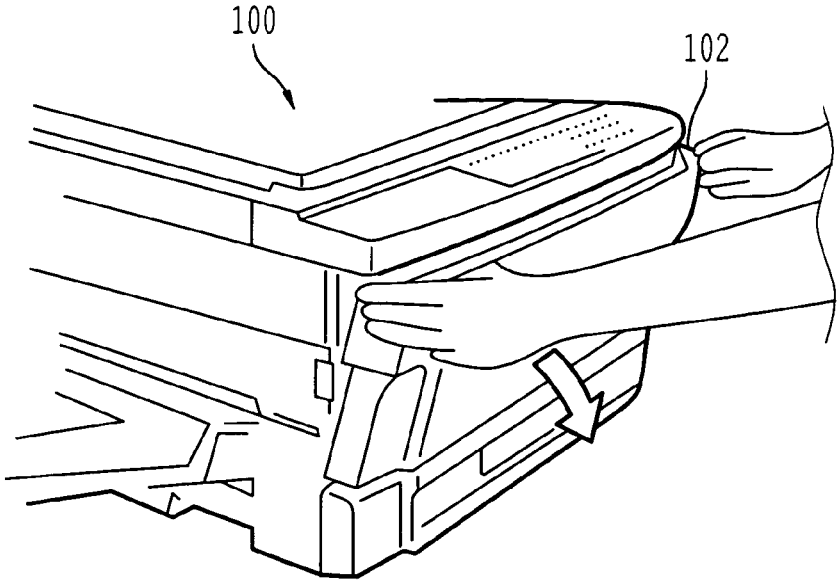
FIG. 12 (BACKGROUND ART)
FIG. 12 is a perspective view of a known image forming apparatus.
Figure 17:
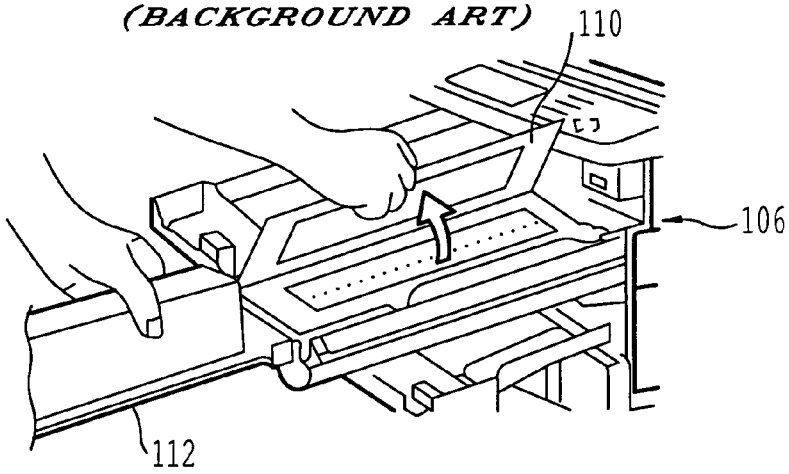
FIG. 17 (BACKGROUND ART)
FIG. 17 is a perspective view of a toner cartridge used for unlocking a locking type toner hopper.
Figure 18:
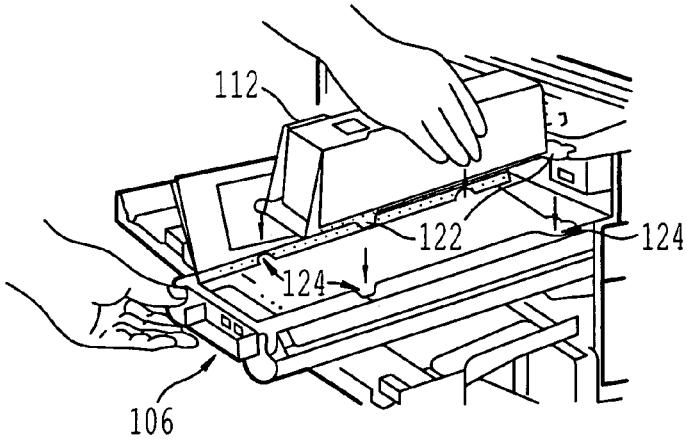
FIG. 18 (BACKGROUND ART)
FIGS. 18 and 19 illustrate the use of a nontoner cartridge for refilling a toner hopper.
Figure 19:
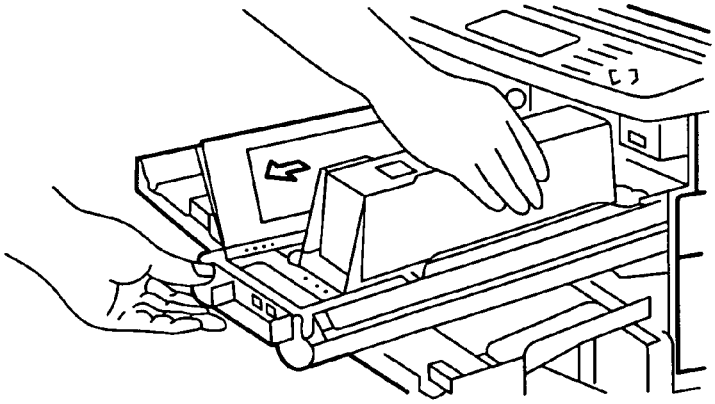
FIG. 19 (BACKGROUND ART)

After toner hopper 24, which is a locking-type toner hopper, has been pulled to the position shown in FIGS. 4 and 5, the protrusions 14 of key 10, are inserted into apertures 28 of locking mechanism 26, so as to release lid 40. Thereafter, lid 40 is opened as shown in FIG. 7. As is well known, toner can be shaken before being filled into a toner reservoir, as shown in FIG. 8. Toner is then poured into toner hopper 24, lid 40 is closed, hopper release lever 46 is closed and then access panel 44 is closed, as shown in FIGS. 9, 10 and 11, respectively.

Since the inside mechanisms of copiers are typically black, key 10 is preferably a color other than black, such as light grey, or any other color that visually distinguishes the key from other components inside conventional copiers. By forming the key in a color other than black, it is less likely that a user will inadvertently leave the key, such as key 10, inserted into a toner hopper lock, such as lock 26, during operation of the image forming device.

By using a key such as key 10, to open a locking-type toner hopper such as toner hopper 24, the present invention avoids the need for an end user to purchase a specially manufactured toner refilling device or container which has specialized components for coupling with hopper devices such as locking mechanism 26 and/or specialized engaging surfaces formed on hopper 24. These specialized containers are often complicated and/or expensive to design, manufacture or maintain and are therefore costly. Therefore, by using key 10, which is of simple design, an end user can avoid the cost and inconvenience associated with buying a complicated toner refilling device, since the hopper can be unlocked with the key and filled with a relatively simply designed toner bottle. Furthermore, by providing a key 10 with a plurality of projections 16 that are arranged so that two different toner hoppers (corresponding to the indicia A and B indicated on the key) can be unlocked with the key, a single key 10 can be packaged with one type of toner bottle, that can be used to refill any image forming apparatus that uses either of the two hoppers. Therefore, it will not be necessary for retailers and end users to stock a different key for every different kind of image forming apparatus which they may have and/or sell parts for.

A toner refilling kit according to a further aspect of the present invention will be described below.

Figure 2:
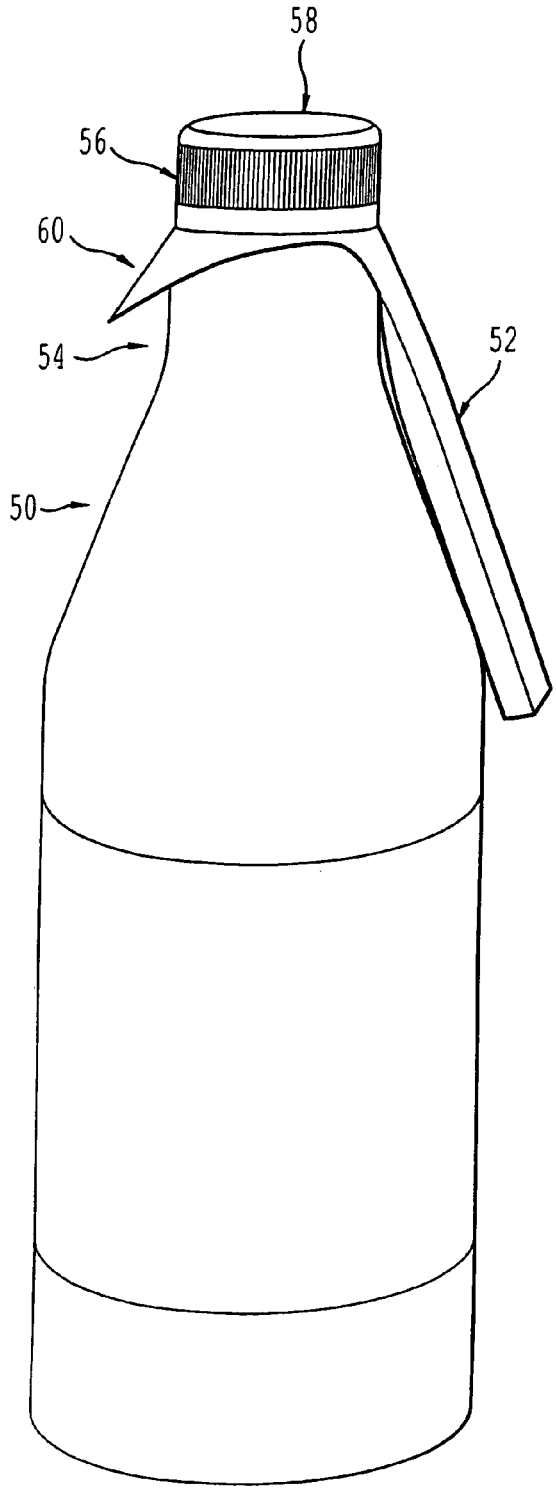
FIG. 2 is a side elevational view of a toner refilling kit according to one aspect of the present invention.

As shown in FIG. 2, toner container 50 is packaged together with a toner hopper key such as key 10. In a presently preferred embodiment, key 10 is packaged together with toner container 50 via pouch 52. In the nonlimiting embodiment shown in FIG. 2, pouch 52 is made out of a thin flexible material such as a foil or plastic in the form of a pouch. In this embodiment, key 10 is sealed within pouch 52. Preferably, toner container 50 has a generally funnel shaped upper end 54 terminating in an aperture 56 sealed with cap 58. In order to conveniently package key 10 within pouch 52 with toner container 50, pouch 52 includes an aperture in its upper end 60 which is made large enough to fit over aperture 56 of toner container 50 such that cap 58, when installed on toner container 50, as shown in FIG. 2, securely attaches pouch 52 to a toner container 50.

By packaging toner container 50 with key 10 into a toner refill kit, a user is able to inexpensively refill an image forming apparatus, such as image forming apparatus 42 that includes a locking-type toner hopper 24, without having to buy the typically expensive, and specially designed toner refill cartridges typically sold for refilling locking-type toner hoppers. Additionally, by packaging toner container 50 with key 10, it is ensured that, even if a user has previously purchased but then lost a key 10, another key will be conveniently located when it is again time to refill toner hopper 24. By packaging a toner bottle together with a key that has a plurality of projections arranged to unlock at least two different locking-type toner hoppers, the present invention provides a single kit that can be used for refilling at least two different models of image forming apparatuses. Therefore, end users and/or retailers which stock such a toner refilling kit, will not be burdened by the necessity to stock a specific toner refill kit for each model of image forming apparatus which they sell or maintain. Finally, by forming the toner container 50 with a funnel shaped upper end 54, the toner bottle can be used to refill toner hoppers of varying shapes. Therefore, the kit shown in FIG. 2, can be used to fill a variety of different image forming apparatuses.

As discussed above, the present invention provides several important advantages over the toner refill kits of the prior art. For example, conventional toner hoppers may have locking toner reservoirs which, in order to be refilled, must be unlocked and engaged with a specialized container which is opened after engaging the container with the reservoir. After the hopper is refilled, the specialized container is disengaged and discarded or returned to the manufacturer for refilling. Therefore, by providing a key configured to unlock a locking type toner hopper, where the key is not monolithically formed with a toner container, the present invention allows a locking toner hopper to be easily and conveniently opened and refilled. Furthermore, since the specialized toner containers which are designed to unlock and engage corresponding specialized hoppers are complicated and costly to manufacture, the present invention provides a low cost alternative for users of photocopiers and other image forming apparatuses for their toner refilling needs.

In addition, according to a further aspect of the invention, by providing a kit that can be used to fill a variety of hopper devices, the present invention significantly reduces the burden on businesses, for example, who own or lease photocopiers. In particular, the present invention allows a user of photocopiers or image forming apparatuses to reduce the number of different specialized toner refill kits needed to refill the different types of photocopiers or of other image forming apparatuses they may operate.

Numerous additional modifications and variations of the present invention are possible in light of the above teachings. It is therefore to be understood that within the scope of the appended claims, the present invention may be practiced otherwise than as specifically described herein.

What is claimed is:

1. A key for unlocking a toner hopper of an image forming apparatus, comprising:

a first member;

at least one first projection attached to said first member, said first projection configured to unlock a first locking-type toner hopper of an image forming apparatus; and at least one second projection attached to the first member, the second projection configured to unlock a second locking-type toner hopper, wherein said key is not formed monolithically with a toner container.

2. The key according to claim 1, wherein said at least one first projection includes at least two first projections configured to be received by, and unlock a lock of the first toner hopper.

3. The key according to claim 2, wherein said at least two first projections have a first spacing, and wherein said at least two first projections are substantially rectangular, and have a width sufficient to allow said at least two first projections to be received by two slots included on the lock of the first hopper.

4. A key for unlocking a toner hopper of an image forming apparatus, comprising:

a first member; and at least one projection attached to said first member, said projection configured to unlock a locking-type toner hopper of an image forming apparatus;

wherein said key is not formed monolithically with a toner container, wherein said at least one projection includes at least two first projections configured to be received by, and unlock a lock of a toner hopper of an image forming apparatus, and wherein said at least two projections have a first spacing, and wherein said key further comprises at least two second projections having a second spacing, said second spacing larger than said first spacing.

5. The key according to claim 4, further comprising a first indicia corresponding to said first at least two projections; and a second indicia corresponding to said at least two second projections.

6. The key according to claim 4, wherein said at least two first projections are provided on an opposite side of said first member from said at least two second projections.

7. A key for unlocking a toner hopper of an image forming apparatus, comprising:

a first member; and at least one projection attached to said first member, said projection configured to unlock a locking-type toner hopper of an image forming apparatus;

wherein said key is not formed monolithically with a toner container, and wherein said key includes a plurality of projections arranged to be received by and unlock, at least two different locking-type toner hoppers.

8. A toner refill kit for refilling a locking hopper of an image forming apparatus, said kit comprising the combination of:

a first container containing toner; and a key having at least one projection configured to be received by and unlock a lock of a toner hopper of an image forming apparatus;

wherein said key is not monolithically formed with said first container.

9. The kit according to claim 8, wherein said at least one projection of said key comprises at least two projections configured to be received by a lock of a locking-type toner hopper of an image forming apparatus.

10. The toner refill kit according to claim 8, wherein the key comprises a protrusion configured to be received by and unlock a lock of another toner hopper.

11. The toner refill kit according to claim 10, wherein the projection comprises at least two projections, and the protrusion comprises at least two protrusions.

12. The toner refill kit according to claim 11, wherein a distance between the at least two projections is greater than a distance between the at least two protrusions.

13. A toner refill kit for refilling a locking hopper of an image forming apparatus, said kit comprising the combination of:

a first container containing toner;

a key having at least one projection configured to be received by and unlock a lock of a toner hopper of an image forming apparatus; and a second container configured to store said key, said second container configured to engage with said first container, wherein said key is not monolithically formed with said first container.

14. A key for unlocking a toner hopper of an image forming apparatus, comprising:

a body member means for unlocking a first locking-type toner hopper of an image forming apparatus, the means for unlocking a first hopper disposed on the body member; and means for unlocking a second locking-type toner hopper, the means for unlocking a second hopper disposed on the body member.

15. The key according to claim 14, wherein the key is separate from a toner container.

16. The key according to claim 14, wherein the key is not configured to container toner.

17. The key according to claim 14, wherein the means for unlocking a first hopper and the means for unlocking a second hopper extend from the body member in directions different from one another.

18. The key according to claim 14, wherein the means for unlocking a first hopper comprise at least one first projection.

19. The key according to claim 14, wherein the means for unlocking a first hopper comprises at least two first projections and the means for unlocking a second hopper comprises at least two second projections.

20. The key according to claim 19, wherein a distance between the at least two first projections is larger than a distance between the at least two second projections.

* * * * *